US008994619B2

(12) United States Patent
Jeong

(10) Patent No.: US 8,994,619 B2
(45) Date of Patent: Mar. 31, 2015

(54) OLED PIXEL CONFIGURATION FOR COMPENSATING A THRESHOLD VARIATION IN THE DRIVING TRANSISTOR, DISPLAY DEVICE INCLUDING THE SAME, AND DRIVING METHOD THEREOF

(75) Inventor: Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 307 days.

(21) Appl. No.: 13/177,405

(22) Filed: Jul. 6, 2011

(65) Prior Publication Data

US 2012/0147060 A1 Jun. 14, 2012

(30) Foreign Application Priority Data

Dec. 10, 2010 (KR) ..... 10-2010-0126489

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2320/0233* (2013.01); *G09G 2320/0252* (2013.01)
USPC ..... 345/76; 345/82

(58) Field of Classification Search
CPC ..... G09G 3/30–3/3291
USPC ..... 345/76, 77, 82
See application file for complete search history.

(56) References Cited

U.S. PATENT DOCUMENTS

2005/0017934 A1 1/2005 Chung et al.
2006/0055336 A1* 3/2006 Jeong ..... 315/169.3
2006/0151745 A1* 7/2006 Kim et al. ..... 252/301.16
2007/0103406 A1 5/2007 Kim (Continued)

FOREIGN PATENT DOCUMENTS

CN 1577453 A 2/2005
CN 1744774 A 3/2006
CN 1964585 A 5/2007
CN 101231821 A 7/2008

(Continued)

OTHER PUBLICATIONS

European Search Report dated Dec. 22, 2011, for corresponding European Patent application 11178920.2, noting listed references in this IDS, 8 pages.

*Primary Examiner* — Chanh Nguyen
*Assistant Examiner* — Roy Rabindranath
(74) *Attorney, Agent, or Firm* — Christie, Parker & Hale, LLP

(57) ABSTRACT

A display device includes: a display unit including pixels coupled to scan lines for transmitting scan signals, data lines for transmitting data signals, and light emission control lines for transmitting light emission control signals; a scan driver; a data driver; and a light emission driver. Each pixel includes: an OLED; a driving transistor to transmit a driving current corresponding to a data signal to the OLED; a first transistor to transmit the data signal to the driving transistor according to a first scan signal; a second transistor to apply a first power source voltage to a first electrode of the driving transistor according to a second scan signal, during an initialization period for initializing a gate electrode voltage of the driving transistor; and a capacitor including a first electrode coupled to a gate electrode of the driving transistor and a second electrode coupled to a first power source supply.

32 Claims, 5 Drawing Sheets

(56) References Cited

U.S. PATENT DOCUMENTS

| | | | | |
|---|---|---|---|---|
| 2008/0143653 | A1* | 6/2008 | Shishido | 345/78 |
| 2008/0150846 | A1* | 6/2008 | Chung | 345/80 |
| 2009/0102829 | A1 | 4/2009 | Abe et al. | |
| 2010/0007649 | A1 | 1/2010 | Tanikame et al. | |
| 2011/0164071 | A1* | 7/2011 | Chung et al. | 345/690 |
| 2011/0227885 | A1* | 9/2011 | Chung et al. | 345/204 |

FOREIGN PATENT DOCUMENTS

| | | | |
|---|---|---|---|
| EP | 1 496 495 | A2 | 1/2005 |
| EP | 1 936 596 | A1 | 6/2008 |
| JP | 2005-031630 | | 2/2005 |
| JP | 2009-210993 | | 9/2009 |
| KR | 10-2008-0066343 | A | 7/2008 |
| KR | 10-2008-0080753 | A | 9/2008 |

* cited by examiner

OLED PIXEL CONFIGURATION FOR COMPENSATING A THRESHOLD VARIATION IN THE DRIVING TRANSISTOR, DISPLAY DEVICE INCLUDING THE SAME, AND DRIVING METHOD THEREOF

CROSS-REFERENCE TO RELATED APPLICATION

This application claims priority to and the benefit of Korean Patent Application No. 10-2010-0126489 filed in the Korean Intellectual Property Office on Dec. 10, 2010, the entire content of which is incorporated herein by reference.

BACKGROUND

1. Field

The present invention relates to a pixel, a display device including the same, and a driving method thereof.

2. Description of the Related Art

Cathode ray tubes (CRTs) have been used to display images. However, CRTs can have the disadvantages of being heavy and large in size. Currently, various flat panel displays are being developed that can reduce the heavy weight and large volume that are drawbacks of CRTs. Examples of flat panel displays include liquid crystal displays (LCDs), field emission displays (FEDs), plasma display panels (PDPs), and organic light emitting diode (OLED) displays.

OLED displays can display images using OLEDs that generate light by recombination of electrons and holes. An OLED display can have a fast response speed, can be driven with low power consumption, and can have the advantages of improved (or excellent) luminous efficiency, luminance, and viewing angle.

Generally, OLED displays can be classified into two types according to the driving method of the OLED display: passive matrix OLEDs (PMOLEDs) and active matrix OLEDs (AMOLEDs).

Of the two types, the active matrix OLED display in which unit pixels are selectively lit is primarily used because of its good resolution, contrast, and operation speed.

One pixel of an active matrix OLED display may include an OLED, a driving transistor for controlling an amount of current supplied to the OLED, and a switching transistor for transmitting a data signal to the driving transistor to control an amount of light emitted by the OLED.

Recently, research has been underway on a compensation circuit to compensate for a threshold voltage variation (or deviation) of the driving transistor included in the pixel of the active matrix OLED display. However, when the compensation circuit is used to display an image at a desired luminance, the response speed of the pixel varies according to an increase/decrease in a data voltage applied to the driving transistor, due to hysteresis, such that it is difficult to correctly display gray levels. For example, a delay in response speed may be generated when driving the OLED display to express a luminance from black to white, and this problem may cause sticking when scrolling text on a screen.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention relate to a pixel, a display device including the same, and a driving method thereof to reduce (or remove) a delay in response speed and reduce sticking while driving a display.

Aspects of embodiments of the present invention provide a pixel circuit that concurrently (e.g., simultaneously) compensates for a threshold voltage variation of a driving transistor while addressing (or solving) the problems of delayed response speed caused by hysteresis and reducing sticking on a screen.

Also, aspects of embodiments of the present invention provide a high quality display device producing high image quality that is capable of compensating for a threshold voltage variation (or deviation) of a driving transistor; correctly expressing gray levels by reducing (or solving) a delay in a response speed, for example, in a case of displaying an image according to a data signal having a large luminance variation (or deviation); and a driving method thereof.

Technical aspects of the present invention are not limited to the above, and other aspects (e.g., non-mentioned aspects) will be clearly understood by a person of ordinary skill in the art by way of the following description.

A display device according to embodiments of the present invention includes: a display unit including a plurality of pixels respectively coupled to a plurality of scan lines for transmitting a plurality of scan signals, a plurality of data lines for transmitting a plurality of data signals, and a plurality of light emission control lines for transmitting a plurality of light emission control signals; a scan driver for transmitting the plurality of scan signals; a data driver for transmitting the plurality of data signals; and a light emission driver for transmitting the plurality of light emission control signals, wherein each pixel of the plurality of pixels includes: an organic light emitting diode (OLED); a driving transistor configured to transmit a driving current corresponding to a data signal from among the plurality of data signals to the OLED; a first transistor configured to transmit the data signal to the driving transistor according to a first scan signal from among the plurality of scan signals; a second transistor configured to apply a first power source voltage to a first electrode of the driving transistor according to a second scan signal from among the plurality of scan signals, during an initialization period for initializing a gate electrode voltage of the driving transistor; and a capacitor including a first electrode coupled to a gate electrode of the driving transistor and a second electrode coupled to a first power source supply.

A voltage difference between the gate electrode voltage and a first electrode voltage of the driving transistor during the initialization period may be a voltage for operating the driving transistor.

The first transistor may be switching-operated according to the first scan signal to transmit the data signal to the first electrode of the driving transistor.

The second scan signal may be transmitted to a previous scan line from among the plurality of scan lines, and the previous scan line may precede the scan line receiving the first scan signal.

The scan driver may be configured to transmit the first scan signal and the second scan signal to the plurality of pixels.

Each pixel of the plurality of pixels may further include: an initialization transistor configured to supply an initialization voltage to the gate electrode of the driving transistor during the initialization period and to initialize the gate electrode voltage of the driving transistor.

The initialization transistor may be switching-operated according to the second scan signal transmitted to a previous scan line from among the plurality of scan lines, and the previous scan line may precede the scan line receiving the first scan signal transmitted to the first transistor.

The initialization period may be a period in which the second scan signal is transmitted to the initialization transistor at a gate-on voltage level.

The initialization period may be before a period in which a threshold voltage of the driving transistor is compensated.

Each pixel of the plurality of pixels may further include: a threshold voltage compensation transistor configured to be switching-operated according to the first scan signal after the initialization period and to diode-couple the driving transistor and compensate a threshold voltage of the driving transistor.

Each pixel of the plurality of pixels may further include: at least one light emission control transistor configured to control light emission of the OLED receiving the driving current according to the data signal.

The at least one light emission control transistor may be configured to be switching-operated according to a light emission control signal from among the plurality of light emission control signals transmitted at a gate-on voltage level, after the first scan signal and the second scan signal are respectively transmitted at the gate-on voltage level to the first transistor and the second transistor.

A pixel according to another embodiment of the present invention includes: an organic light emitting diode (OLED); a driving transistor configured to transmit a driving current to the OLED according to a data signal; a first transistor configured to transmit the data signal to the driving transistor according to a first scan signal; a second transistor configured to apply a first power source voltage to a source electrode of the driving transistor according to a second scan signal during an initialization period for initializing a gate electrode voltage of the driving transistor; and a capacitor including a first electrode coupled to a gate electrode of the driving transistor and a second electrode coupled to a first power source supply.

A voltage difference between the gate electrode voltage and a source electrode voltage of the driving transistor during the initialization period may be a voltage for operating the driving transistor.

The first transistor may include a gate electrode for receiving the first scan signal, a source electrode for receiving the data signal, and a drain electrode coupled to the source electrode of the driving transistor, and the first transistor may be switching-operated according to the first scan signal and may be configured to transmit the data signal to the source electrode of the driving transistor.

The second scan signal may be transmitted to a second scan line preceding a first scan line receiving the first scan signal.

The pixel may further include: an initialization transistor configured to supply an initialization voltage to the gate electrode of the driving transistor during the initialization period and to initialize the gate electrode voltage of the driving transistor.

The initialization transistor may include: a gate electrode for receiving the second scan signal, a source electrode applied with the initialization voltage, and a drain electrode coupled to the gate electrode of the driving transistor, and the initialization transistor may be configured to be switching-operated according to the second scan signal.

The initialization period may be a period in which the second scan signal is transmitted to the initialization transistor at a gate-on voltage level.

The initialization period may be before a period in which a threshold voltage of the driving transistor is compensated.

The pixel may further include: a threshold voltage compensation transistor configured to be switching-operated according to the first scan signal after the initialization period and to diode-couple the driving transistor and compensate a threshold voltage of the driving transistor.

The pixel may further include: at least one light emission control transistor coupled between the first power source supply and the OLED and including a gate electrode for receiving a light emission control signal for controlling light emission of the OLED receiving the driving current according to the data signal.

The at least one light emission control signal may be transmitted at a gate-on voltage level after the first scan signal and the second scan signal are respectively transmitted at the gate-on voltage level to the first transistor and the second transistor in the pixel.

The at least one light emission control transistor may further include: a source electrode coupled to a drain electrode of the driving transistor, and a drain electrode coupled to an anode of the OLED.

The at least one light emission control transistor may further include: a source electrode coupled to the first power source supply, and a drain electrode coupled to the source electrode of the driving transistor.

According to another embodiment of the present invention, a method is provided for driving a display device including a plurality of pixels, wherein each pixel of the plurality of pixels includes: an organic light emitting diode (OLED); a driving transistor for transmitting a driving current to the OLED according to a data signal; a first transistor for transmitting the data signal to the driving transistor according to a first scan signal; a second transistor for applying a first power source voltage to the driving transistor according to a second scan signal; and a capacitor coupled between the driving transistor and a first power source supply, the method including: initializing a gate electrode voltage of the driving transistor; compensating for a threshold voltage of the driving transistor and transmitting the data signal to the driving transistor; and providing the driving current to the OLED according to the data signal to produce light emission, wherein the second scan signal is transmitted at a gate-on voltage level during the initializing the gate electrode voltage of the driving transistor.

A voltage between a gate electrode and a source electrode of the driving transistor may be a voltage for operating the driving transistor during the initializing the gate electrode voltage of the driving transistor.

The second scan signal may be transmitted to a second scan line preceding a first scan line receiving the first scan signal.

The initializing the gate electrode voltage of the driving transistor may include applying an initialization voltage to a gate electrode of the driving transistor via an initialization transistor configured to be switching-operated according to the second scan signal.

The compensating for the threshold voltage of the driving transistor may include diode-coupling the driving transistor via a threshold voltage compensation transistor configured to be switching-operated according to the first scan signal. The providing the driving current to the OLED according to the data signal to produce light emission may include controlling the light emission of the OLED via at least one light emission control transistor coupled between the first power source supply and the OLED, and the at least one light emission control transistor may be configured to be switching-operated by a light emission control signal.

The light emission control signal may be transmitted at the gate-on voltage level after the first scan signal and the second scan signal are respectively transmitted at the gate-on voltage level to the first transistor and the second transistor.

According to the pixel and the display device including the same of embodiments of the present invention, the problem of the delay in response speed caused by hysteresis may be reduced (or solved) and the sticking on the screen may be reduced such that a grayscale may be correctly expressed.

Also, according to embodiments of the present invention, a delay in response speed may be concurrently (e.g., simultaneously) reduced (or prevented) when displaying an image according to a data signal having a large luminance variation (or deviation), while concurrently compensating for a threshold voltage variation (or deviation) of a driving transistor such that a high quality display producing high image quality may be realized.

DETAILED DESCRIPTION OF THE EMBODIMENTS

Figure 1:
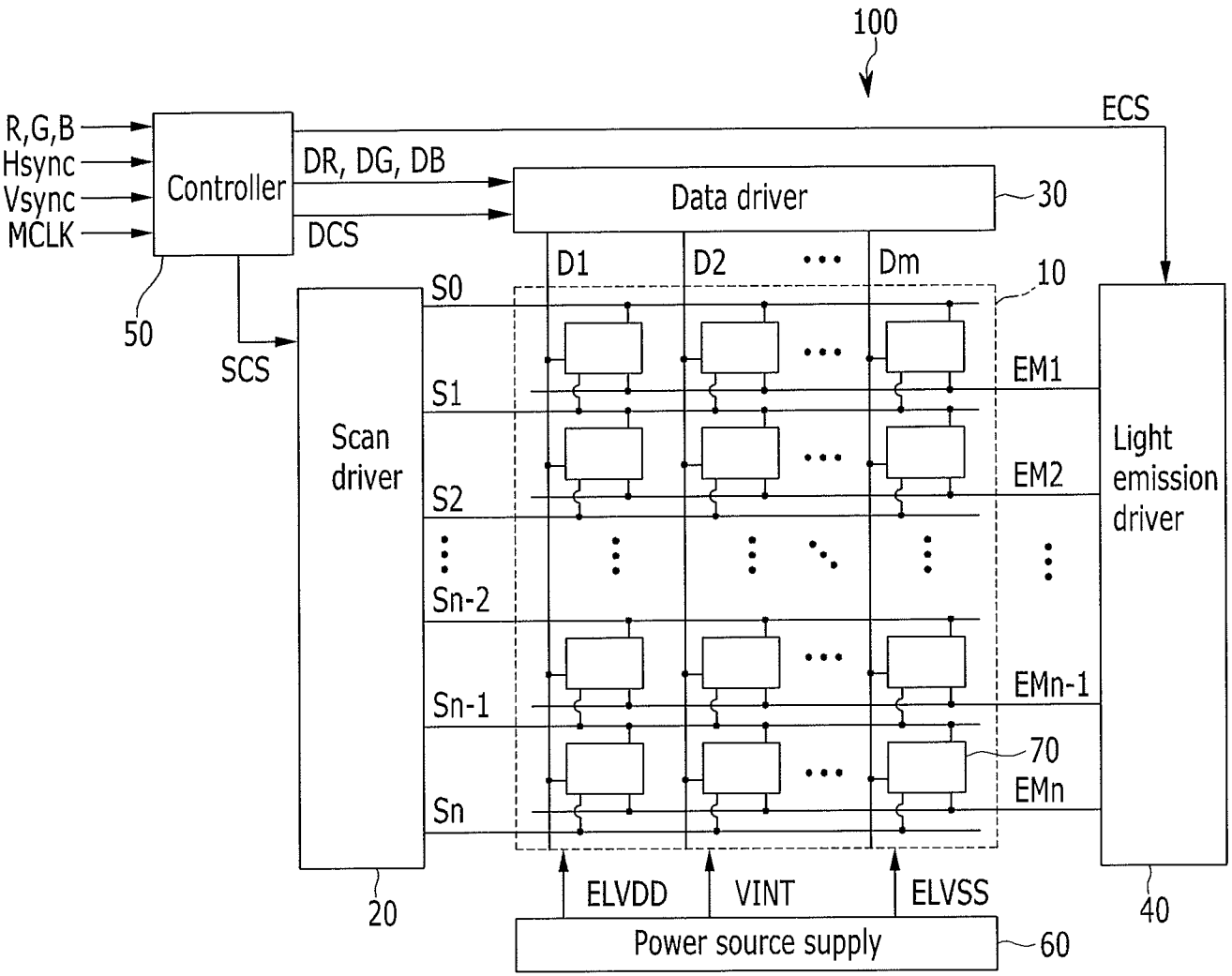
FIG. 1 is a block diagram of a display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Further, constituent elements having the same configurations in the exemplary embodiments are exemplarily described in a first exemplary embodiment using like reference numerals, and only configurations different from those in the first exemplary embodiment will be described in other exemplary embodiments.

In addition, some of the parts that are not essential to the description are omitted for clarity, and like reference numerals designate like elements and similar constituent elements throughout the application.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of the stated elements but not the exclusion of any other elements.

FIG. 1 is a block diagram of a display device according to an exemplary embodiment of the present invention.

A display device 100 according to an exemplary embodiment of the present invention includes a display unit 10 including a plurality of pixels, a scan driver 20, a data driver 30, a light emission driver 40, a controller 50, and a power source supply unit 60 supplying an external voltage to the display device.

A plurality of pixels are respectively coupled to two scan lines among a plurality of scan lines S0 to Sn for transmitting scan signals to the display unit 10. In FIG. 1, each pixel is coupled to a scan line that corresponds to a corresponding pixel row, and each pixel is also coupled to the scan line of the previous row thereof. However, embodiments of the present invention are not limited thereto.

Also, each pixel of a plurality of pixels is respectively coupled to one data line among a plurality of data lines D1 to Dm for transmitting data signals to the display unit 10, and one light emission control line among a plurality of light emission control lines EM1 to EMn for transmitting emission control signals to the display unit 10.

In one embodiment, the scan driver 20 generates and transmits two corresponding scan signals to the pixels through a plurality of scan lines S0 to Sn. That is, the scan driver 20 transmits the first scan signal through the scan line corresponding to the pixel row including the pixels, and the second scan signal through the scan line corresponding to the previous pixel row.

In the exemplary embodiment of FIG. 1, one pixel 70 among a plurality of pixels included in the nth pixel row is respectively coupled to the scan line Sn corresponding to the corresponding nth pixel row and the scan line Sn−1 corresponding to the previous (n−1)th pixel row.

The pixel 70 receives the first scan signal through the scan line Sn, and concurrently (e.g., simultaneously) receives the second scan signal through the scan line Sn−1.

The data driver 30 transmits a data signal to each pixel through a plurality of data lines D1 to Dm.

The light emission driver 40 generates and transmits a light emission control signal to each pixel through a plurality of light emission control lines EM1 to EMn.

The controller 50 converts (or changes) a plurality of video signals R, G, and B transmitted from an external source into a plurality of image data signals DR, DG, and DB, and transmits them to the data driver 30. Also, the controller 50 receives a vertical synchronization signal Vsync, a horizontal synchronization signal Hsync, and a clock signal MCLK to generate control signals to control the driving of the scan driver 20, the data driver 30, and the light emission driver 40. That is, the controller 50 generates and transmits the scan driving control signal SCS controlling the scan driver 20, the data driving control signal DCS controlling the data driver 30, and the light emitting driving control signal ECS controlling the light emission driver 40.

According to one embodiment, the display unit 10 includes a plurality of pixels positioned at crossing regions of a plurality of scan lines S0 to Sn, a plurality of data lines D1 to Dm, and a plurality of light emission control lines EM1 to EMn.

The plurality of pixels are supplied with external voltages such as a first power source voltage ELVDD, a second power source voltage ELVSS, and an initialization voltage VINT from the power source supply unit 60. The first power source voltage ELVDD may have a higher voltage level than the second power source voltage ELVSS.

The display unit 10 includes a plurality of pixels arranged in an approximate matrix format. The plurality of scan lines S0 to Sn extend substantially in a row in a first direction so as to be parallel to each other, and the plurality of data lines extend substantially in a column, in a second direction crossing the first direction, so as to be parallel to each other in the arrangement of the pixels. However, embodiments of the present invention are not limited thereto.

A plurality of pixels respectively emit light having a luminance (e.g., a predetermined luminance), by way of a driving current supplied to an OLED in each pixel, according to a data signal transmitted through a plurality of data lines D1 to Dm.

Figure 2:
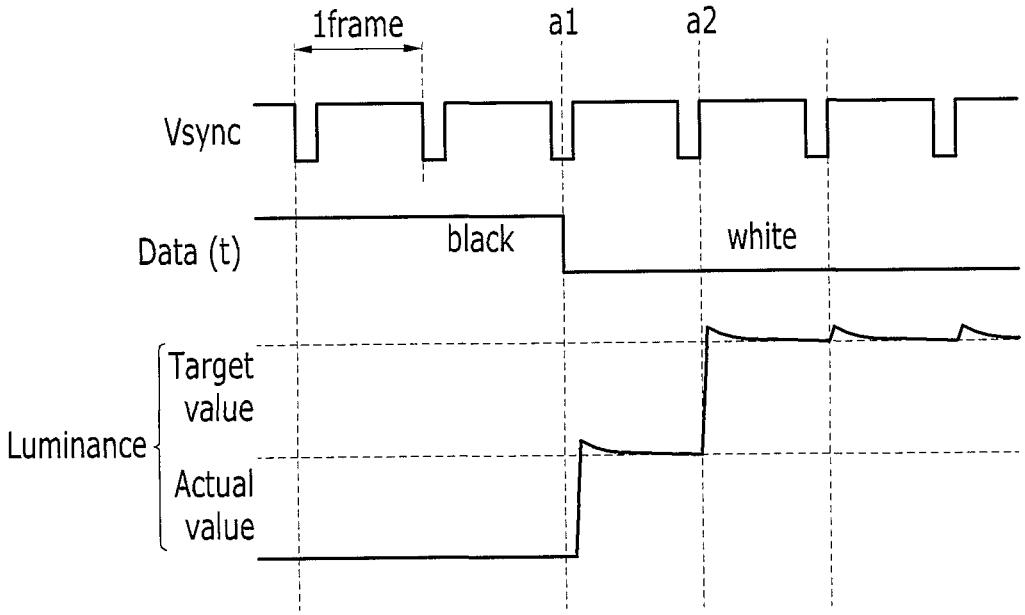
FIG. 2 is a waveform diagram of a delay in response speed due to hysteresis during expression of gray levels in a conventional pixel circuit.

FIG. 2 is a waveform diagram of a delay in a response speed due to hysteresis during expression of gray levels in a conventional pixel circuit.

In a general (or conventional) pixel circuit for compensating for a threshold voltage of a driving transistor, pixels of the display unit are scanned for one frame. The vertical synchronization signal Vsync is transmitted to the scanned pixels and the scanned pixels receive the data signal Data[t] to display the images.

When the plurality of pixels of the display unit that are displayed with a black image or a white image corresponding to the data signal are driven for a long time, the voltage level applied to the driving transistor in each pixel may be maintained such that hysteresis according thereto is generated. In this case, when displaying the image of a current frame, the gray level may be shifted to the left side or the right side of a TFT characteristic curve by an influence of the gray voltage of the previous frame.

For example, when the pixels are driven with the black image for a long time, the voltage level applied to the driving transistor is an off-bias voltage that is less than an operation reference voltage of the driving transistor. Accordingly, the gray level according to the video signal of the next frame is shifted to the right side of the TFT characteristic curve. In contrast, when the pixels are driven with the white image for a long time, the voltage level applied to the driving transistor is an on-bias voltage that is more than the operation reference voltage of the driving transistor, and thereby the gray level according to the video signal of the next frame is shifted to the left side of the TFT characteristic curve.

Accordingly, the response speeds may be different according to the change in the amount of the luminance between the previous frame and the current frame, due to the hysteresis of the driving transistor of the pixel when displaying the same luminance. These response speeds may vary (e.g., deteriorate) according to the application time of the off-bias voltage or the on-bias voltage applied to the driving transistor.

Accordingly, improvement of the pixel circuit to concurrently (e.g., simultaneously) address (or solve) the response speed problem due to hysteresis while compensating for a threshold voltage variation (or deviation) of a transistor in the pixel is needed.

In the waveform diagram of FIG. 2, a pixel that is displayed with a black luminance for a long time according to a black data signal Data[t] receives a white data signal emitting light with a white luminance, at the time a1. As shown in FIG. 2, the pixel does not immediately emit light having luminance target values corresponding to the white data signal at the time a1, when the white data signal is first transmitted, but emits light having the luminance target values at the time a2 after one frame has passed.

When driving the pixel to display images from black to white, in one frame the light may not reach (or may not be increased to) the target value of the white luminance, and may only arrive at a middle luminance. Therefore, the response speed may be delayed compared with the case where the pixel is driven to display the image from white to white. The delay in the response speed due to this hysteresis is manifest (or represented) as sticking during text scrolling of the display screen.

A pixel circuit structure and a driving method according to an embodiment of the present invention address (or solve) the problem of the delay in response speed caused by hysteresis.

Figure 3:
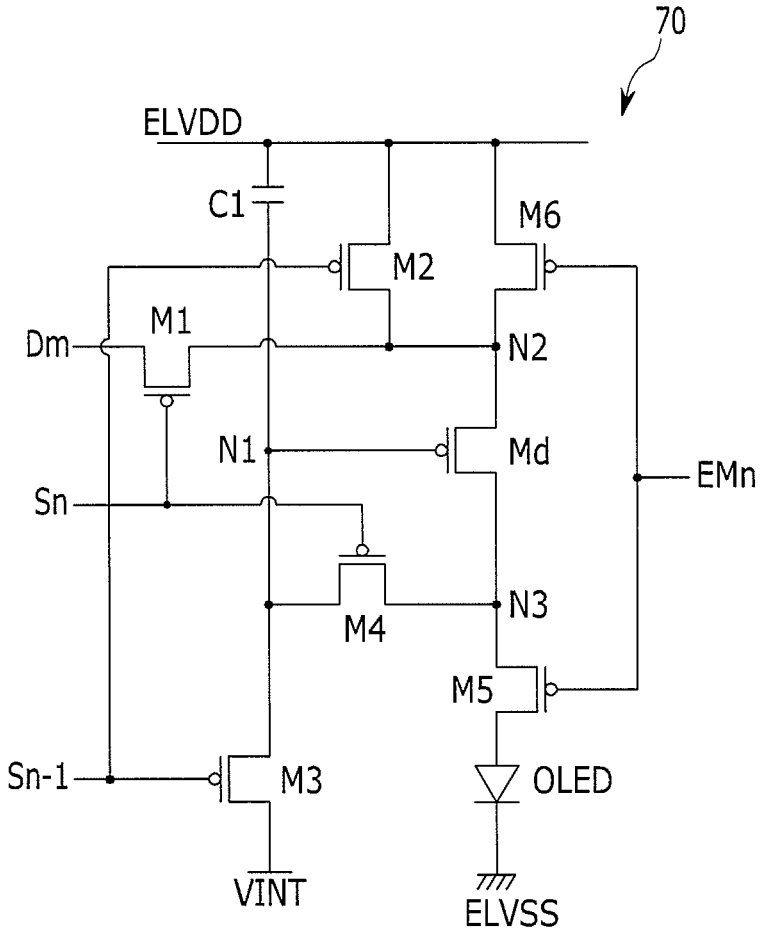
FIG. 3 is a circuit diagram of a pixel circuit of the display device shown in FIG. 1.

FIG. 3 is a circuit diagram showing a circuit structure of a pixel 70 of the display device 100 shown in FIG. 1 according to an exemplary embodiment of the present invention.

A pixel according to an exemplary embodiment of the present invention is coupled to a first scan line and a second scan line. The second scan line applies an initialization voltage VINT to a driving transistor Md in the pixel during an initialization period and transmits a second scan signal controlling the driving transistor Md to maintain it with the operation voltage (on-bias voltage). The first scan line transmits a first scan signal to activate the pixel to transmit the data signal.

The pixel 70 shown in FIG. 3 is respectively coupled to the nth scan line Sn and the (n−1)th scan line Sn−1 among a plurality of pixels included in the display unit 10 of the display device 100 of FIG. 1. Also, the pixel 70 is coupled to the mth data line Dm and the nth light emission control line EMn.

The pixel 70 shown in FIG. 3 includes an OLED; a driving transistor Md coupled to an anode of the OLED; a first transistor M1 coupled to the source electrode of the driving transistor Md; a second transistor M2, which has one electrode coupled to a node N2 that is coupled to the driving transistor Md and the first transistor M1, and another electrode that is coupled to the first power source voltage ELVDD; and a capacitor C1 between the driving transistor Md and the first power source voltage ELVDD.

The pixel 70 may further include an initialization transistor M3 for transmitting the initialization voltage VINT during the initialization period.

The pixel 70 may further include a threshold voltage compensation transistor M4 diode-coupling the driving transistor Md to compensate for the threshold voltage of the driving transistor Md.

Also, the pixel 70 may further include at least one light emission control transistor coupled to the anode of the OLED and controlling light emission according to the driving current of the OLED. The light emission control transistor included in the pixel 70 of FIG. 3 includes a first light emission control transistor M5 coupled between the anode of the OLED and the driving transistor Md, and a second light emission control transistor M6 coupled between the driving transistor Md and the first power source voltage ELVDD.

The OLED of the pixel 70 has an anode and a cathode, and emits light as a result of the driving current corresponding to a corresponding data signal. According to an aspect of embodiments of the present invention, the driving current corresponding to the data signal is compensated for, so as not to be affected by the variations in threshold voltage of the driving transistor included in each of the pixels of the display unit 10.

The driving transistor Md includes a source electrode coupled to the second node N2 to which the first power source voltage ELVDD is coupled, a drain electrode coupled to a third node N3, and a gate electrode coupled to the first node N1. The driving transistor Md receives the data signal through the first transistor M1 coupled to the second node N2.

The driving transistor Md transmits the driving current corresponding to the voltage difference between its source electrode and its gate electrode to the OLED for light emission.

The first transistor M1 includes a source electrode coupled to the data line Dm and transmitting the data signal, a drain electrode coupled to the second node N2, and a gate electrode coupled to the scan line Sn corresponding to the pixel row including the pixel 70 and transmitting the scan signal S[n]. Here, the pixel 70 is included in the nth pixel row such that the corresponding scan line is the nth scan line.

If the scan signal S[n] is transmitted through the nth scan line such that the first transistor M1 is turned on, the data signal is transmitted to the second node N2, and the data voltage Vdata corresponding to the data signal is transmitted to the source electrode of the driving transistor Md.

The scan signal S[n] is also concurrently (e.g., simultaneously) transmitted to the gate electrode of the threshold voltage compensation transistor M4.

The threshold voltage compensation transistor M4 is coupled between the gate electrode and the drain electrode of the driving transistor Md, and is turned on during the time that the scan signal S[n] is transmitted as the gate-on voltage level to diode-couple the driving transistor Md. Thus, a data voltage Vdata applied to the source electrode of the driving transistor Md is reduced by the threshold voltage of the driving transistor Md such that a voltage Vdata-Vth is applied to the gate electrode of the driving transistor Md. The gate electrode of the driving transistor Md is coupled to one terminal of the capacitor C1 such that the voltage Vdata-Vth is maintained by the capacitor C1. The voltage Vdata-Vth reflecting the threshold voltage Vth of the driving transistor Md is applied to the gate electrode of the driving transistor Md and is maintained such that the driving current flowing in the driving transistor Md is not affected by variations in the threshold voltage of the driving transistor Md.

The second transistor M2 includes a gate electrode coupled to the (n−1)th scan line and receiving the scan signal S[n−1], a source electrode coupled to the first power source voltage ELVDD, and a drain electrode coupled to the second node N2.

The second transistor M2 is turned on by the scan signal S[n−1], which is transmitted at a gate-on voltage level through the (n−1)th scan line before the scan signal S[n] is transmitted to the pixel 70 through the nth scan line at the gate-on voltage level.

Thus, the first power source voltage ELVDD is applied to the source electrode of the driving transistor Md during the period in which the driving transistor Md is switched on by the scan signal S[n−1].

The initialization transistor M3 transmitting the initialization voltage VINT to the gate electrode of the driving transistor Md is switching-operated by the scan signal S[n−1].

The initialization transistor M3 includes a gate electrode coupled to the (n−1)th scan line, a source electrode coupled to the voltage source transmitting the initialization voltage VINT, and a drain electrode coupled to the gate electrode of the driving transistor Md.

The initialization voltage VINT is applied to the gate electrode of the driving transistor Md during the time that the scan signal S[n−1] is transmitted to the initialization transistor M3 as the gate-on voltage level. The gate electrode of the driving transistor Md is initialized at the initialization voltage VINT during a period in which the scan signal S[n−1] is transmitted at the gate-on voltage level.

During the initialization period in which the scan signal S[n−1] is transmitted at the gate-on voltage level, the source electrode of the driving transistor Md is applied with the first power source voltage ELVDD, and concurrently (e.g., simultaneously) the gate electrode of the driving transistor Md is applied with the initialization voltage VINT, and thereby the voltage difference Vgs between the gate and the source of the driving transistor Md during the initialization period becomes ELVDD-VINT. This is a voltage value that is greater than the reference voltage at which the driving transistor Md is operated.

The voltage difference Vgs between the gate and the source of the driving transistor Md during the initialization period is more than the reference voltage such that the driving transistor Md is on-biased.

The data voltage is written to the driving transistor Md during the state in which the driving transistors Md of all of the pixels are on-biased, and thereby the hysteresis characteristic may be improved.

When a plurality of driving transistors are applied with the data voltage of the previous frame, the gate-source voltage of each driving transistor may be at a different level than the gate-source voltage of each driving transistor in the current frame, before the data voltage of the current frame is written.

If there is no initialization period, the hysteresis characteristic of the gate-source voltage of each driving transistor may be different depending on whether the data voltage of the current frame is a higher or lower voltage than the data voltage of the previous frame. In an exemplary embodiment of the present invention, the gate-source voltage of each driving transistor during the initialization period becomes ELVDD-VINT such that all of the driving transistors are on-biased with the same condition (e.g., all of the driving transistors have the same gate-source voltage).

Accordingly, the gate-source voltage of the driving transistors of all pixels is determined according to the data voltage of the current frame in the same conditions without the effect of the hysteresis characteristic.

In an exemplary embodiment of the present invention, the signal controlling the switching operation of the second transistor M2 and the initialization transistor M3 uses the scan signal transmitted through the previous scan line of the scan line coupled to the corresponding pixel row, however it is not limited thereto and an additional control signal may be transmitted.

On the other hand, in the case of the pixel included in the first pixel row, the scan signal transmitted to the second transistor M2 and the initialization transistor M3 may be a dummy scan signal that is generated and transmitted from the scan driver 20.

For example, the capacitor C1 includes a first electrode coupled to the first node N1 and a second electrode coupled to the first power source voltage ELVDD.

The capacitor C1 is coupled to the first node N1 to which the gate electrode of the driving transistor Md is coupled, thereby storing the voltage value of the gate electrode of the driving transistor Md according to the driving process of the pixel.

Also, the first light emission control transistor M5 of the pixel 70 according to an exemplary embodiment of the present invention includes a gate electrode coupled to the nth light emission control line and receiving the light emission control signal EM[n], a source electrode coupled to the third node N3, and a drain electrode organic coupled to the anode of the light emitting diode OLED.

The pixel 70 may include the second light emission control transistor M6, and the second light emission control transistor M6 has a gate electrode coupled to the nth light emission control line and receiving the light emission control signal EM[n], a source electrode coupled to the first power source voltage ELVDD, and a drain electrode coupled to the second node N2.

The light emission control transistor according to embodiments of the present invention is only one example and the pixel circuit configuration is not limited thereto.

If the light emission control signal EM[n] is transmitted at the gate-on voltage level, the first light emission control transistor M5 and the second light emission control transistor M6 are turned on. The driving current corresponding to the data voltage stored in the capacitor C1 is transmitted to the OLED according to the data signal and during the data writing period, such that light is emitted. As described above, the data voltage stored to the capacitor C1 is the voltage value Vdata-Vth reflecting the threshold voltage Vth such that the effect of variations in the threshold voltage is reduced when light emission occurs due to the corresponding driving current.

Although the transistors included in the driving circuit of the pixel shown in FIG. 3 are PMOS transistors, embodiments of the present invention are not limited thereto, and the transistors may be realized as NMOS transistors.

Figure 4:
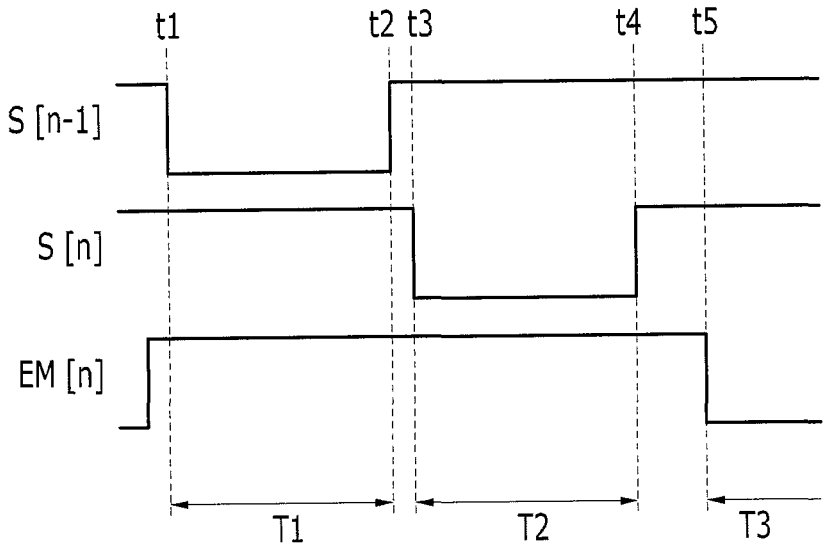
FIG. 4 is a timing diagram showing a driving operation of the pixel circuit shown in FIG. 3.

A driving timing diagram is shown in FIG. 4 for comprehension of the driving of the pixel 70 shown in FIG. 3.

The pixel 70 according to an exemplary embodiment of the present invention is coupled to two scan lines to receive the scan signals and be operated.

First, the scan signal S[n−1] is transmitted through the (n−1)th scan line and is transitioned (or changed) to a low level at the time t1 and maintains the low level during the period T1.

Accordingly, the second transistor M2 and the initialization transistor M3 receiving the scan signal S[n−1] in the pixel are concurrently (e.g., simultaneously) turned on.

The first power source voltage ELVDD having a high level voltage is applied to the source electrode of the driving transistor Md through the second transistor M2 during the period T1, and the initialization voltage VINT is applied to the gate electrode of the driving transistor Md through the initialization transistor M3.

The gate-source voltage difference Vgs of the driving transistor Md is maintained as ELVDD-VINT during the period T1. At this time, the initialization voltage VINT is at a low level such that the voltage difference Vgs may be more than a minimum reference voltage for operating the driving transistor Md. Accordingly, the driving transistors Md included in all of the pixels are on-biased before the period in which the threshold voltage of the driving transistor Md is compensated for and the data is written in each frame. Accordingly, an image that is displayed with the desired gray level may be realized regardless of the hysteresis characteristic of the driving transistor Md.

Next, the scan signal S[n−1] is transitioned to a high level at the time t2, and the scan signal S[n] transmitted through the nth scan line is transitioned (or changed) to a low level at the time t3 and maintains the low level during the period T2.

The scan signal S[n−1] is transmitted at the high level (or maintains the high state) during the period T2 such that the second transistor M2 and the initialization transistor M3 are turned off, and the first node N1 is floating.

Concurrently (e.g., simultaneously), the first transistor M1 and the threshold voltage compensation transistor M4 receiving the scan signal S[n] in the pixel during period T2 are turned on. Thus, the data voltage Vdata according to the data signal DATA is transmitted to the source electrode of the driving transistor Md through the first transistor M1 during the period T2, and the driving transistor Md is diode-coupled with the threshold voltage compensation transistor M4.

Accordingly, the voltage maintained at the first node N1 coupled to one terminal of the capacitor C1 during the period T2 is the voltage Vgs. The voltage Vgs corresponds to the voltage difference between gate and source electrodes of the driving transistor Md, and is represented by the voltage value Vdata-Vth, which is the data voltage Vdata reduced by the threshold voltage Vth of the driving transistor Md.

The driving transistor Md is on-biased during the initialization period of the period T1 such that the hysteresis characteristic may be reduced (or improved), and thereby the delay problem of the response speed may be improved (or solved) during the expression of gray levels according to the data voltage Vdata.

When the scan signal S[n] is transitioned to a high level at the time t4, the first transistor M1 and the threshold voltage compensation transistor M4 are turned off. Thus, the first node N1 is again floating.

The light emission control signal EM[n] transmitted to the pixel 70 included in the nth pixel row is transitioned (or changed) to the low level at the time t5.

Thus, the first light emission control transistor M5 and the second light emission control transistor M6 receiving the light emission control signal EM[n] of the pixel 70 are turned on, and the driving current stored to the capacitor C1 and corresponding to the data voltage according to the data signal is transmitted to the OLED for light emission.

The voltage value for calculating the driving current is the corresponding voltage ELVDD-Vdata, excluding the effect of the threshold voltage Vth of the driving transistor Md.

Figure 5:
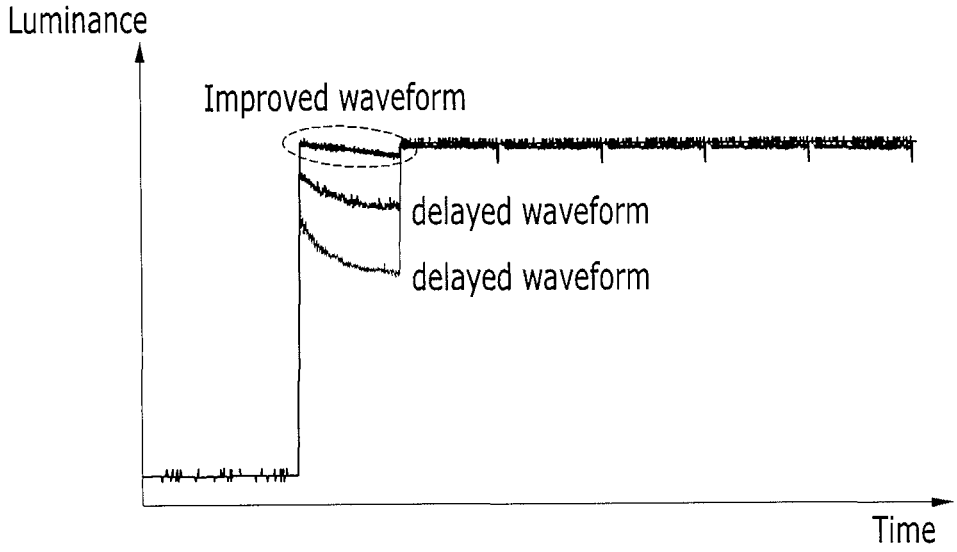
FIG. 5 is a waveform diagram showing an improved response speed in a display device according to an exemplary embodiment of the present invention.

The pixel and the display device including the same according to an exemplary embodiment of the present invention may concurrently (e.g., simultaneously) reduce (or solve the problem of) the delay in the response speed due to hysteresis while reducing (or excluding) the effect of variations in the threshold voltage of the driving transistor when displaying the image according to the data signal, such that the response speed is not delayed and light is emitted with the desired luminance in the corresponding frame as shown in the waveform diagram in FIG. 5. As a result, a clear and high quality image may be provided.

Referring to the waveform diagram of FIG. 5, if the display device is driven using a conventional pixel, the light is not emitted with the desired luminance due to hysteresis, but is displayed with a luminance of a middle degree, and then the light is emitted with a normal luminance in the next frame. However, if the display device is driven through a pixel according to embodiments of the present invention, an improved waveform displaying an improved luminance (e.g., a desired luminance) in the corresponding frame may be obtained.

Although the present invention is described with reference to detailed exemplary embodiments of the present invention, this is by way of example only and the present invention is not limited thereto. A person of ordinary skill in the art may change or modify the described exemplary embodiments without departing from the scope of the present invention, and the changes or modifications are also included in the scope of the present invention. Further, materials of each of the components described in the present specification may be selected from or replaced by various materials known to a person of ordinary skill in the art. In addition, a person of ordinary skill in the art may omit some of the components described in the present application without deteriorating the performance, or may add components in order to improve the performance. Further, a person of ordinary skill in the art may change a sequence of processes described in the present application, according to the process environments or equipment. Therefore, while the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

DESCRIPTION OF SOME OF THE REFERENCE NUMERALS

100: display device
10: display unit
20: scan driver
30: data driver
40: light emission driver
50: controller
60: power source supply
70: pixel

What is claimed is:

1. A display device comprising:

a display unit comprising a plurality of pixels respectively coupled to a plurality of scan lines for transmitting a plurality of scan signals, a plurality of data lines for transmitting a plurality of data signals, and a plurality of light emission control lines for transmitting a plurality of light emission control signals;

a scan driver for transmitting the plurality of scan signals;

a data driver for transmitting the plurality of data signals; and a light emission driver for transmitting the plurality of light emission control signals, wherein each pixel of the plurality of pixels comprises:

an organic light emitting diode (OLED);

a driving transistor configured to transmit a driving current corresponding to a data signal from among the plurality of data signals to the OLED;

a first transistor configured to transmit the data signal to the driving transistor according to a first scan signal from among the plurality of scan signals;

a second transistor configured to apply a first power source voltage of a first power source supply to a first electrode of the driving transistor according to a second scan signal from among the plurality of scan signals, during an initialization period for initializing a gate electrode voltage of a gate electrode of the driving transistor; and a capacitor comprising a first electrode coupled to the gate electrode of the driving transistor and a second electrode directly connected to the first power source supply, wherein the first electrode of the driving transistor is coupled to a first electrode of the first transistor, wherein the first power source supply is configured to supply the driving current transmitted by the driving transistor, the driving current flowing through the first electrode and a second electrode of the driving transistor.

2. The display device of claim 1, wherein a voltage difference between the gate electrode voltage and a first electrode voltage of the driving transistor during the initialization period is a voltage for operating the driving transistor.

3. The display device of claim 1, wherein the first transistor is switching-operated according to the first scan signal to transmit the data signal to the first electrode of the driving transistor.

4. The display device of claim 1, wherein the second scan signal is transmitted to a previous scan line from among the plurality of scan lines, wherein the previous scan line precedes the scan line receiving the first scan signal.

5. The display device of claim 1, wherein the scan driver is configured to transmit the first scan signal and the second scan signal to the plurality of pixels.

6. The display device of claim 1, wherein each pixel of the plurality of pixels further comprises:

an initialization transistor configured to supply an initialization voltage to the gate electrode of the driving transistor during the initialization period and to initialize the gate electrode voltage of the driving transistor.

7. The display device of claim 6, wherein the initialization transistor is switching-operated according to the second scan signal transmitted to a previous scan line from among the plurality of scan lines, wherein the previous scan line precedes the scan line receiving the first scan signal transmitted to the first transistor.

8. The display device of claim 6, wherein the initialization period is a period in which the second scan signal is transmitted to the initialization transistor at a gate-on voltage level.

9. The display device of claim 1, wherein the initialization period is before a period in which a threshold voltage of the driving transistor is compensated.

10. The display device of claim 1, wherein each pixel of the plurality of pixels further comprises:

a threshold voltage compensation transistor configured to be switching-operated according to the first scan signal after the initialization period and to diode-couple the driving transistor and compensate a threshold voltage of the driving transistor.

11. The display device of claim 1, wherein each pixel of the plurality of pixels further comprises:

at least one light emission control transistor configured to control light emission of the OLED receiving the driving current according to the data signal.

12. The display device of claim 11, wherein the at least one light emission control transistor is configured to be switching-operated according to a light emission control signal from among the plurality of light emission control signals transmitted at a gate-on voltage level, after the first scan signal and the second scan signal are respectively transmitted at the gate-on voltage level to the first transistor and the second transistor.

13. A pixel comprising:

an organic light emitting diode (OLED);

a driving transistor configured to transmit a driving current to the OLED according to a data signal;

a first transistor configured to transmit the data signal to the driving transistor according to a first scan signal;

a second transistor configured to apply a first power source voltage of a first power source supply to a source electrode of the driving transistor according to a second scan signal during an initialization period for initializing a gate electrode voltage of a gate electrode of the driving transistor; and a capacitor comprising a first electrode coupled to the gate electrode of the driving transistor and a second electrode directly connected to the first power source supply, wherein the source electrode of the driving transistor is coupled to a first electrode of the first transistor, wherein the first power source supply is configured to supply the driving current transmitted by the driving transistor, the driving current flowing through the source electrode and a drain electrode of the driving transistor.

14. The pixel of claim 13, wherein a voltage difference between the gate electrode voltage and a source electrode voltage of the driving transistor during the initialization period is a voltage for operating the driving transistor.

15. The pixel of claim 13, wherein the first transistor comprises a gate electrode for receiving the first scan signal, a source electrode for receiving the data signal, and a drain electrode coupled to the source electrode of the driving transistor, wherein the first transistor is switching-operated according to the first scan signal and is configured to transmit the data signal to the source electrode of the driving transistor.

16. The pixel of claim 13, wherein the second scan signal is transmitted to a second scan line preceding a first scan line receiving the first scan signal.

17. The pixel of claim 13, further comprising:

an initialization transistor configured to supply an initialization voltage to the gate electrode of the driving transistor during the initialization period and to initialize the gate electrode voltage of the driving transistor.

18. The pixel of claim 17, wherein the initialization transistor comprises:

a gate electrode for receiving the second scan signal, a source electrode applied with the initialization voltage, and a drain electrode coupled to the gate electrode of the driving transistor, wherein the initialization transistor is configured to be switching-operated according to the second scan signal.

19. The pixel of claim 17, wherein the initialization period is a period in which the second scan signal is transmitted to the initialization transistor at a gate-on voltage level.

20. The pixel of claim 13, wherein the initialization period is before a period in which a threshold voltage of the driving transistor is compensated.

21. The pixel of claim 13, further comprising:

a threshold voltage compensation transistor configured to be switching-operated according to the first scan signal after the initialization period and to diode-couple the driving transistor and compensate a threshold voltage of the driving transistor.

22. The pixel of claim 13, further comprising:

at least one light emission control transistor coupled between the first power source supply and the OLED and comprising a gate electrode for receiving a light emission control signal for controlling light emission of the OLED receiving the driving current according to the data signal.

23. The pixel of claim 22, wherein the at least one light emission control signal is transmitted at a gate-on voltage level after the first scan signal and the second scan signal are respectively transmitted at the gate-on voltage level to the first transistor and the second transistor in the pixel.

24. The pixel of claim 22, wherein the at least one light emission control transistor further comprises:

a source electrode coupled to a drain electrode of the driving transistor, and a drain electrode coupled to an anode of the OLED.

25. The pixel of claim 22, wherein the at least one light emission control transistor further comprises:

a source electrode coupled to the first power source supply, and a drain electrode coupled to the source electrode of the driving transistor.

26. A method of driving a display device comprising a plurality of pixels, wherein each pixel of the plurality of pixels comprises: an organic light emitting diode (OLED); a driving transistor for transmitting a driving current to the OLED according to a data signal; a first transistor for transmitting the data signal to the driving transistor according to a first scan signal; a second transistor for applying a first power source voltage of a first power source supply to a source electrode of the driving transistor according to a second scan signal; and a capacitor coupled to a gate electrode of the driving transistor and directly connected to the first power source supply, the method comprising:

initializing a gate electrode voltage of the driving transistor;

compensating for a threshold voltage of the driving transistor and transmitting the data signal to the driving transistor; and providing the driving current to the OLED according to the data signal to produce light emission, wherein the second scan signal is transmitted at a gate-on voltage level during the initializing the gate electrode voltage of the driving transistor, wherein the source electrode of the driving transistor is coupled to a first electrode of the first transistor, wherein the first power source supply is configured to supply the driving current provided by the driving transistor, the driving current flowing through the source electrode and a drain electrode of the driving transistor.

27. The method of claim 26, wherein a voltage between the gate electrode and the source electrode of the driving transistor is a voltage for operating the driving transistor during the initializing the gate electrode voltage of the driving transistor.

28. The method of claim 26, wherein the second scan signal is transmitted to a second scan line preceding a first scan line receiving the first scan signal.

29. The method of claim 26, wherein the initializing the gate electrode voltage of the driving transistor comprises applying an initialization voltage to the gate electrode of the driving transistor via an initialization transistor configured to be switching-operated according to the second scan signal.

30. The method of claim 26, wherein the compensating for the threshold voltage of the driving transistor comprises diode-coupling the driving transistor via a threshold voltage compensation transistor configured to be switching-operated according to the first scan signal.

31. The method of claim 26, wherein the providing the driving current to the OLED according to the data signal to produce light emission comprises controlling the light emission of the OLED via at least one light emission control transistor coupled between the first power source supply and the OLED, wherein the at least one light emission control transistor is configured to be switching-operated by a light emission control signal.

32. The method of claim 31, wherein the light emission control signal is transmitted at the gate-on voltage level after the first scan signal and the second scan signal are respectively transmitted at the gate-on voltage level to the first transistor and the second transistor.

* * * * *